US006723906B2

(12) United States Patent
Bourgoin

(10) Patent No.: US 6,723,906 B2
(45) Date of Patent: Apr. 20, 2004

(54) SOFT DRUM CASE

(76) Inventor: Richard E. Bourgoin, 6520 103rd Ave., NE., Kirkland, WA (US) 98033

( * ) Notice: Subject to any disclaimer, the term of this patent is extended or adjusted under 35 U.S.C. 154(b) by 0 days.

(21) Appl. No.: 10/216,205

(22) Filed: Aug. 12, 2002

(65) Prior Publication Data

US 2003/0136243 A1 Jul. 24, 2003

Related U.S. Application Data

(60) Provisional application No. 60/349,240, filed on Jan. 18, 2002.

(51) Int. Cl.[7] ..... G10D 13/02
(52) U.S. Cl. ..... 84/411 R; 84/416; 84/453
(58) Field of Search ..... 84/411 R, 416, 84/453

(56) References Cited

U.S. PATENT DOCUMENTS

| | | | | |
|---|---|---|---|---|
| 501,318 A | | 7/1893 | Boulanger | 206/314 |
| 1,084,719 A | | 1/1914 | Wanamaker | 150/162 |
| 4,927,017 A | * | 5/1990 | Easter | 206/316.2 |
| 5,117,724 A | * | 6/1992 | Gardner | 84/421 |
| 5,520,462 A | * | 5/1996 | Clark | 383/37 |
| 6,025,549 A | | 2/2000 | Harris | 84/411 R |
| 6,263,610 B1 | * | 7/2001 | Doubts, Jr. | 43/26 |

* cited by examiner

*Primary Examiner*—Shih-Yung Hsieh
(74) *Attorney, Agent, or Firm*—Richard C. Litman

(57) ABSTRACT

A soft case for instrumental drums which has a three layer, elongated, rectangular, flat casing made of flexible materials. The front layer is made heavy weight fabric and the back layer is made a lighter weight fabric. The middle layer is laminated between the outer and inner layers and is made of foam padding. When in use, the casing is wrapped around the shell of a drum. The ends of the casing overlap and are removably secured to one another with hook and loop fastening material. The sides of the casing are drawn taut around the rims of the drum with drawstrings. When not in use, the soft case may be rolled up and stored in a minimum of volume.

8 Claims, 5 Drawing Sheets

SOFT DRUM CASE

CROSS-REFERENCE TO RELATED APPLICATION

This application claims the benefit of U.S. Provisional Patent Application Ser. No. 60/349,240, filed Jan. 18, 2002.

BACKGROUND OF THE INVENTION

1. Field of the Invention

The present invention relates to protective cases, in particular to a protective case for a musician's drums.

2. Description of Related Art

Many musicians travel from venue to venue to play their instruments. The great majority of these musicians must carry their own instruments to and from each show. One of the more difficult and time consuming instruments to carry is a drum set. In order to protect a set of drums during travel most musicians place their drums in some type of protective device.

There are currently two types of protective devices for drums available: road cases and soft bags. Road cases are heavy hard-shelled drum-shaped containers with lids and a thick foam lining. Soft bags are essentially a padded, enclosed cloth cylinder with a zipper extending around its circumference. Both of these devices function to adequately pad and protect drums in transit, but they also take up a large volume of space when they are not in use.

U.S. Pat. No. 501,318 discloses a typical related art drum case. The case consists of a two part hard shell which encloses a drum. These cases, unlike the present invention, are difficult to transport due to their size and weight and cannot be conveniently stored in a small area.

U.S. Pat. No. 1,084,719 shows a drum bag with a modified hard top and bottom. It is often difficult to place a drum in a drum bag due to the bags lack of structure. Also, drum bags cannot be rolled and conveniently stored.

U.S. Pat. No. 6,025,549 discloses an inclement weather drum cover which functions to enclose and protect a drum while not significantly reducing the playability of the drum. This drum cover, unlike the present invention, covers the entire drum, thus adding additional weight, and it cannot be rolled and conveniently stored.

None of the above inventions and patents, taken either singly or in combination, is seen to describe the instant invention as claimed.

SUMMARY OF THE INVENTION

The soft drum case is a flexible rectangular cover for transport and storage of a drum, the cover having a front, back, top, bottom and two opposing sides. The cover has front, back and middle layers. The front layer is made of a heavyweight, durable fabric, the middle layer is made of lightweight foam or padding, and the back layer is made of a durable fabric of lighter weight than the outer front layer.

When in use, the soft drum case is wrapped securely around the shell of a drum, with the back layer of the case coming into contact with the shell. The ends of the case overlap and are removably attached to one another with hook and loop fastening material. Drawstrings are sewn into sheathes along the top and bottom of the case. When the drawstrings are pulled, the portions of the top and bottom of the case that extend past the rims of the drum are drawn toward the center of each drum head, completing the formation of a protective case around the drum shell and rim.

The shell and rim of a drum are the areas most likely to be scratched or damaged in transit.

When the soft drum case is not in use, one case, or several cases stacked one on top of the other, may be rolled starting at one end and rolling toward the other end. The rolled cases are then secured with hook and loop fasteners sewn onto the inner and outer layer of the case.

Accordingly, it is a principal object of the invention to adequately protect drums from the hazards of travel when in use and to occupy a minimum volume of space when not in use.

It is another object of this invention to provide a drum protection device that is lightweight and easy to transport.

Still another object of the invention is to provide a drum protection device that is adjustable to fit a variety of drum sizes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
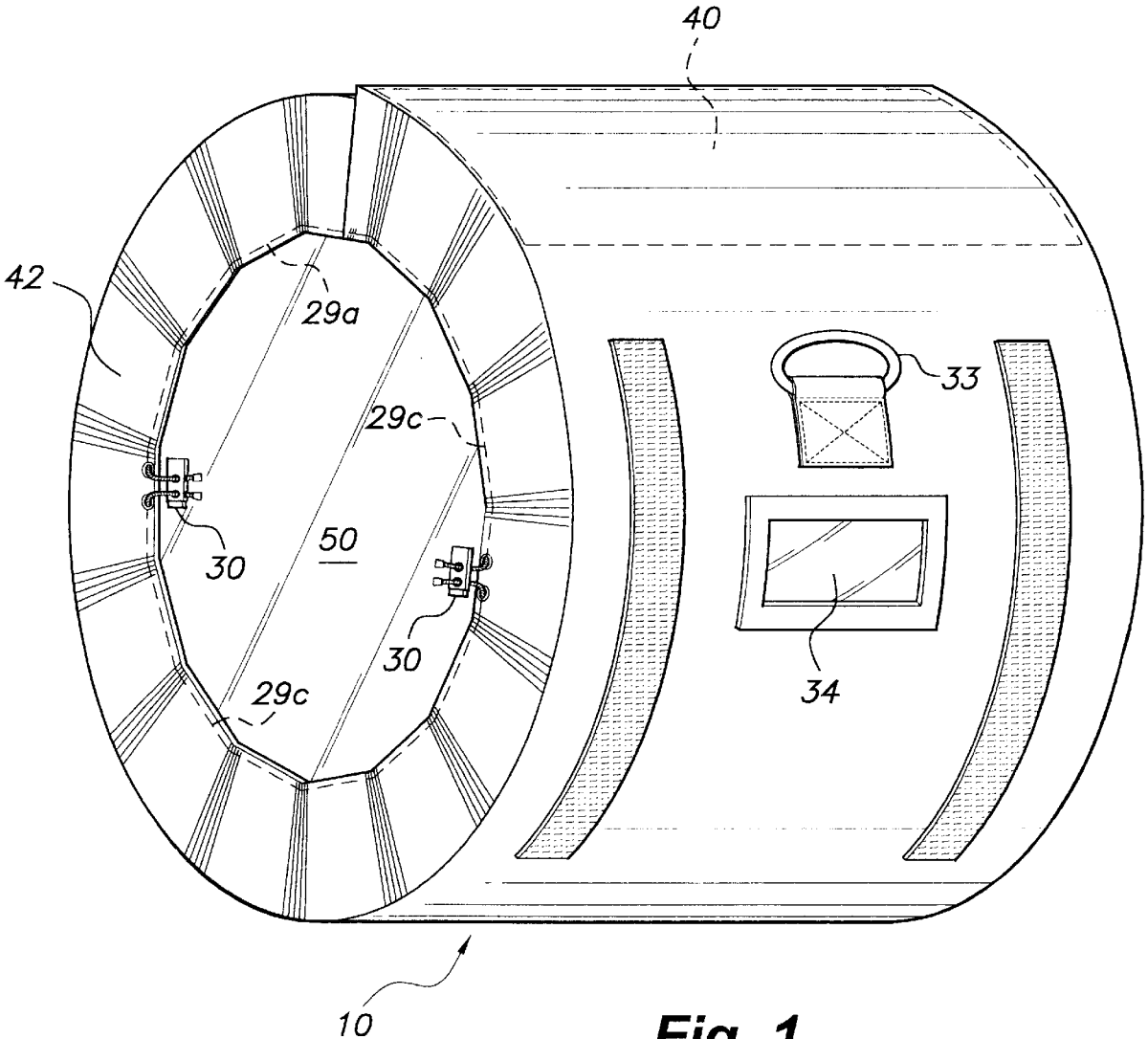
FIG. 1 is an environmental, perspective view of a soft drum case encasing a drum according to the present invention.
Figure 2:
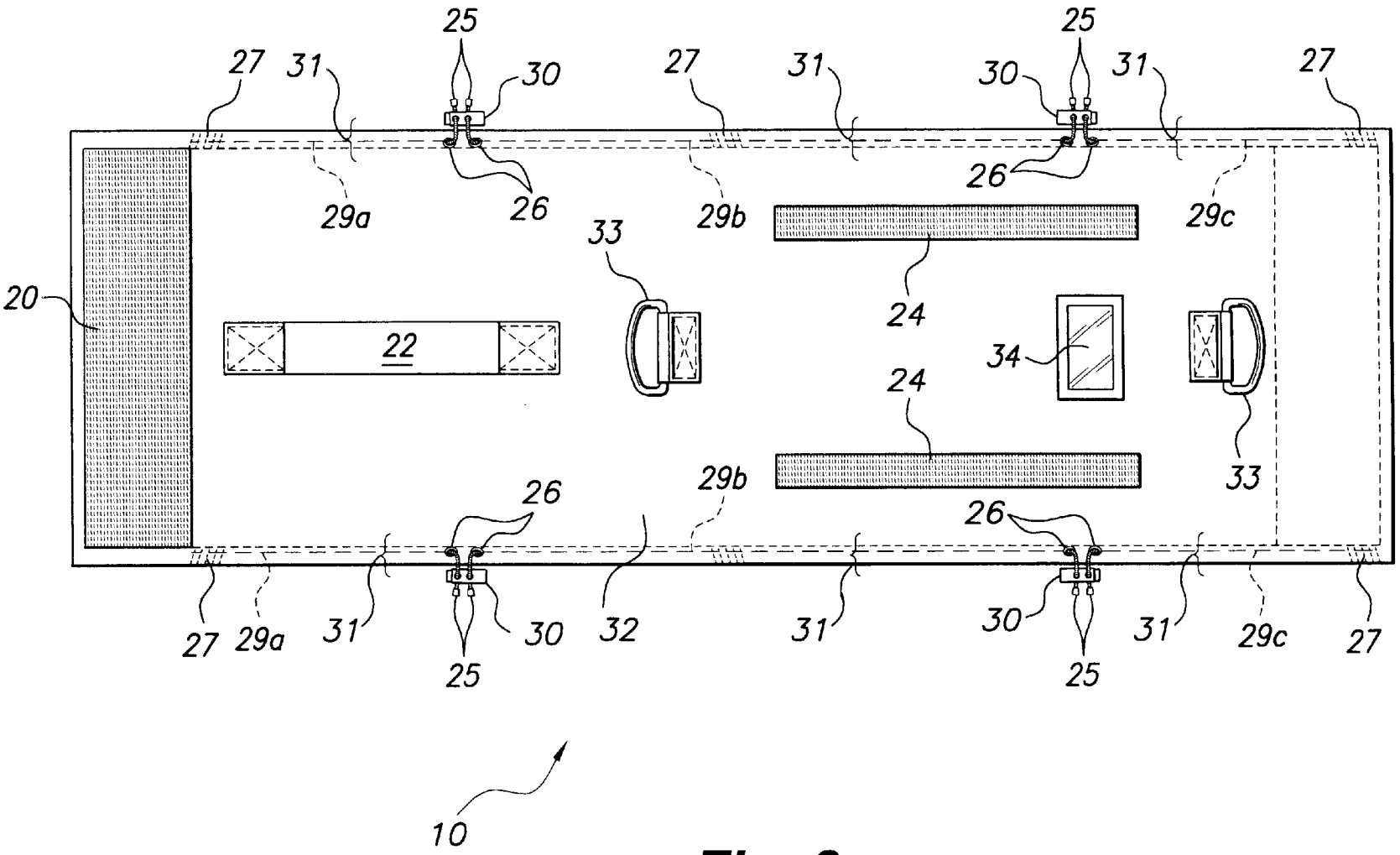
FIG. 2 is a front view of the soft drum case without an encased drum.

The present invention, as shown in FIG. 1, is a soft case 10 that wraps around a drum 50 in order to protect the drum during travel. FIG. 2 shows a front view of the soft case. The soft case 10 is a flexible, rectangular drum cover with a front, back, top, bottom and two opposing sides. The case 10 is made of three layers (discussed below), the front layer 32 being shown in FIG. 2. Sewn to the front layer 32 is a two inch wide nylon webbing strap 22, two D-shaped rings 33, a transparent plastic pocket 34, two one inch by twelve inch loop portions of hook and loop fastening material 24 in parallel, spaced relation, and a four inch wide loop portion 20 of hook and loop connection material that extends from the top to the bottom of the case. The overall length and width of the case 10 and its associated parts will differ depending on the size of the drum to be encased.

Figure 3:
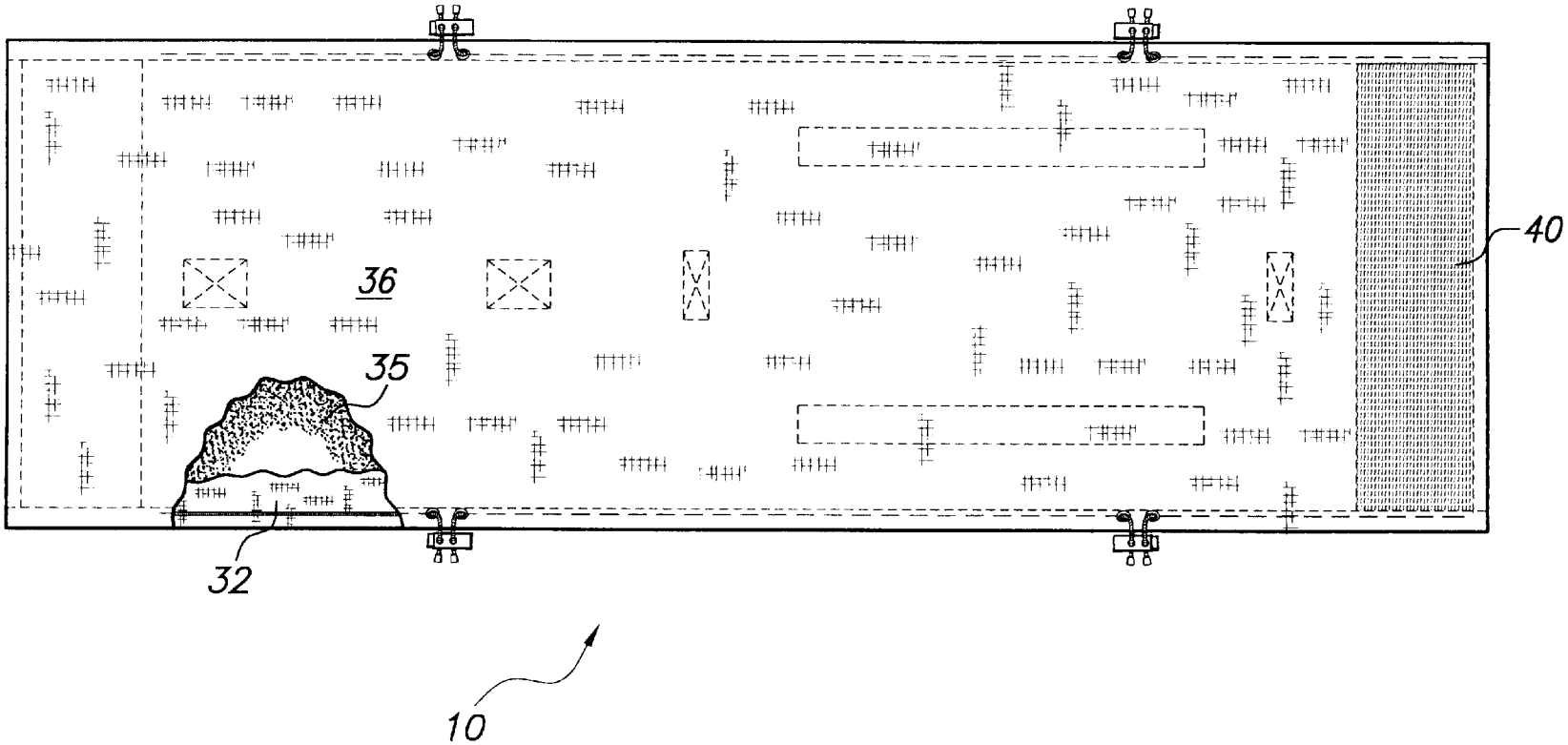
FIG. 3 is a rear view of a soft drum case without an encased drum, with a cut away portion exposing the middle layers of the casing.

FIG. 3 shows a back view of the soft case 10 and has a cutaway section exposing the different layers that make up the case 10. The case 10 has a back layer 36, a middle layer 35 and a front layer 32. The front layer 32 is made of a 1000 denier durable fabric, preferably an air textured, high tenacity nylon sold under the trade name CORDURA. The middle layer 35 is made of lightweight, 3/16" thick foam, and the back layer 36 is made of a durable fabric of a lighter weight than the outer front layer 32, preferably 200 denier nylon Oxford. Attached to one side of the inner back layer 36 is a four inch wide hook portion 40 of hook and loop fastening material.

As illustrated in FIG. 2, two elongated sheaths 31 are defined along the top and bottom of the front layer. A drawstring constructed of cords 29*a*, 29*b*, 29*c*, each cord having two opposing ends and a middle, is threaded through each sheath 31. Each cord 29*a*, 29*b*, 29*c* is anchored to the sheath 31, preferably with stitching 27, with cords 29*a* and 29*c* being anchored along one of their opposing ends and cord 29*b* being anchored along its middle. The method of anchoring the drawstrings is not critical to the invention and the drawstrings, for example, may be glued to the sheath, or anchored with cord locks. The cords are preferably constructed of an inelastic material, although elastic cords are also within the scope of the invention.

Four holes 26 are defined in each sheath 31. The cords 29*a*, 29*b*, 29*c* are looped in and out of the sheath 31 through the holes 26. The double cord locks 30 are positioned on the portions of the cords 29*a*, 29*b*, 29*c* extending outside the sheaths 31. A hand grip 25 may be attached to the ends of the cords 29*a*, 29*b*, 29*c* to prevent the cords from slipping through the cord locks 30. When the case 10 is wrapped around a drum, the case 10 forms a cylinder with the double cord locks 30 approximately 180° apart from each other and 90° from the drawstring anchor stitching 27. In this manner each cord lock 30 needs to only provide tension on a portion of the circumference of the top and bottom of the case 10, making it easier to pull the case 10 taut against the rims of the drum 50. The holes 26 may be reinforced with grommets in order to prevent fraying of sheath material, and to prevent the double cord locks 30 from being pulled into the sheath 31.

Figure 4:
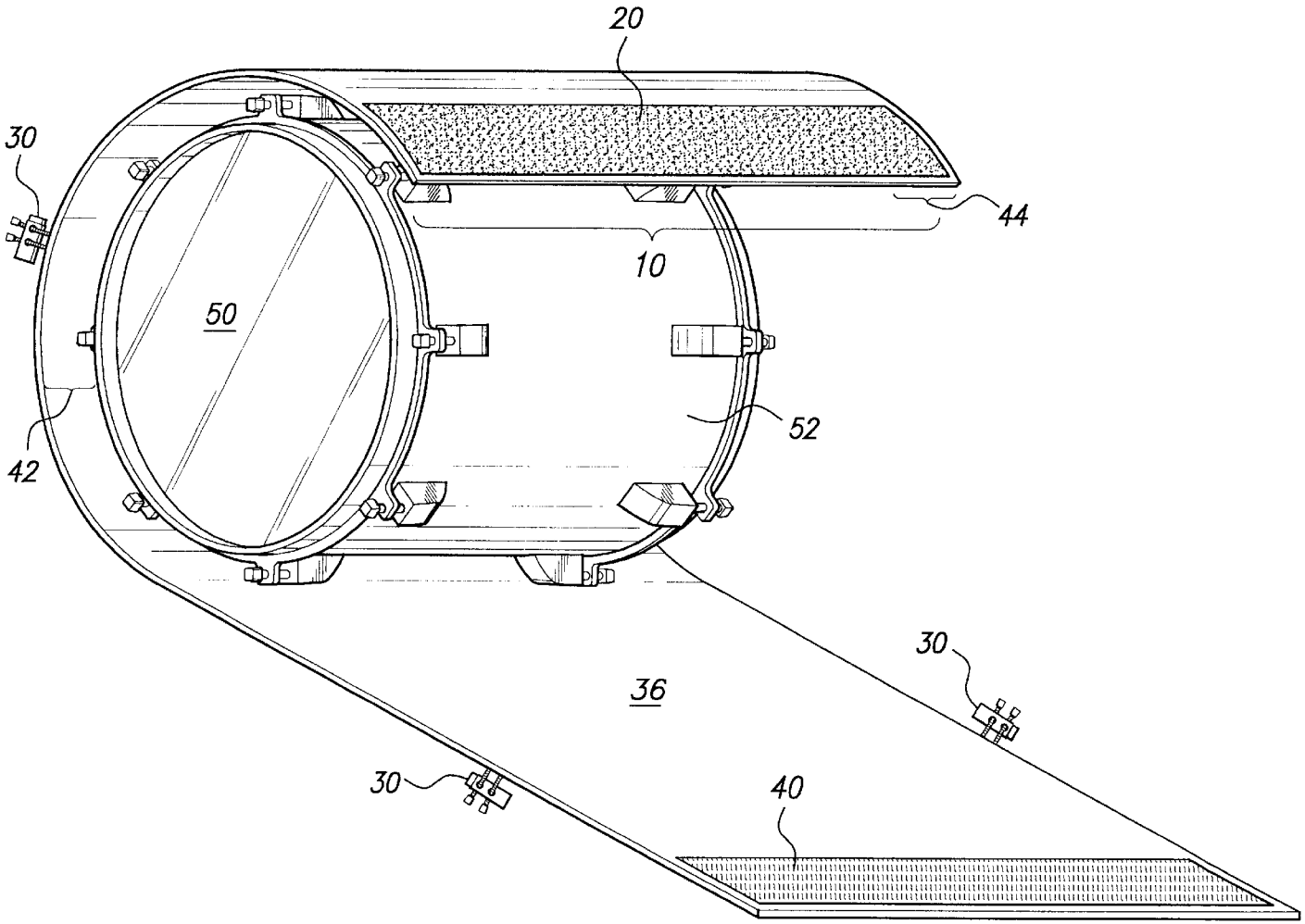
FIG. 4 is a perspective view of a soft drum case partially encasing a drum.

As seen in FIG. 4, the soft case 10 is securely wrapped around a drum 50 with the back layer 36 coming into contact with the shell 52 of the drum 50. One side overlaps the other side and the two sides are removably secured to each other with pieces 20 and 40 of hook and loop fastener. Portions of the top 42 and bottom 44 of the case 10 extend past the rims of the drum 50. The drawstrings are pulled taught at the double cord locks 30 and the extending top 42 and bottom 44 portions collapse toward the centers of the drum heads 50 forming a protective layer around the drum rims. FIG. 1 shows the case 10 after the drawstring has been pulled taut.

A conventional nylon web carry strap may be attached to the D-shaped rings 33 by snap hooks and the case 10 may be carried using the strap. The case 10 may also be transported using the nylon webbing strap 22 as a handle. Identification cards or other materials may be inserted into the transparent pocket 34 for display purposes.

Figure 5:
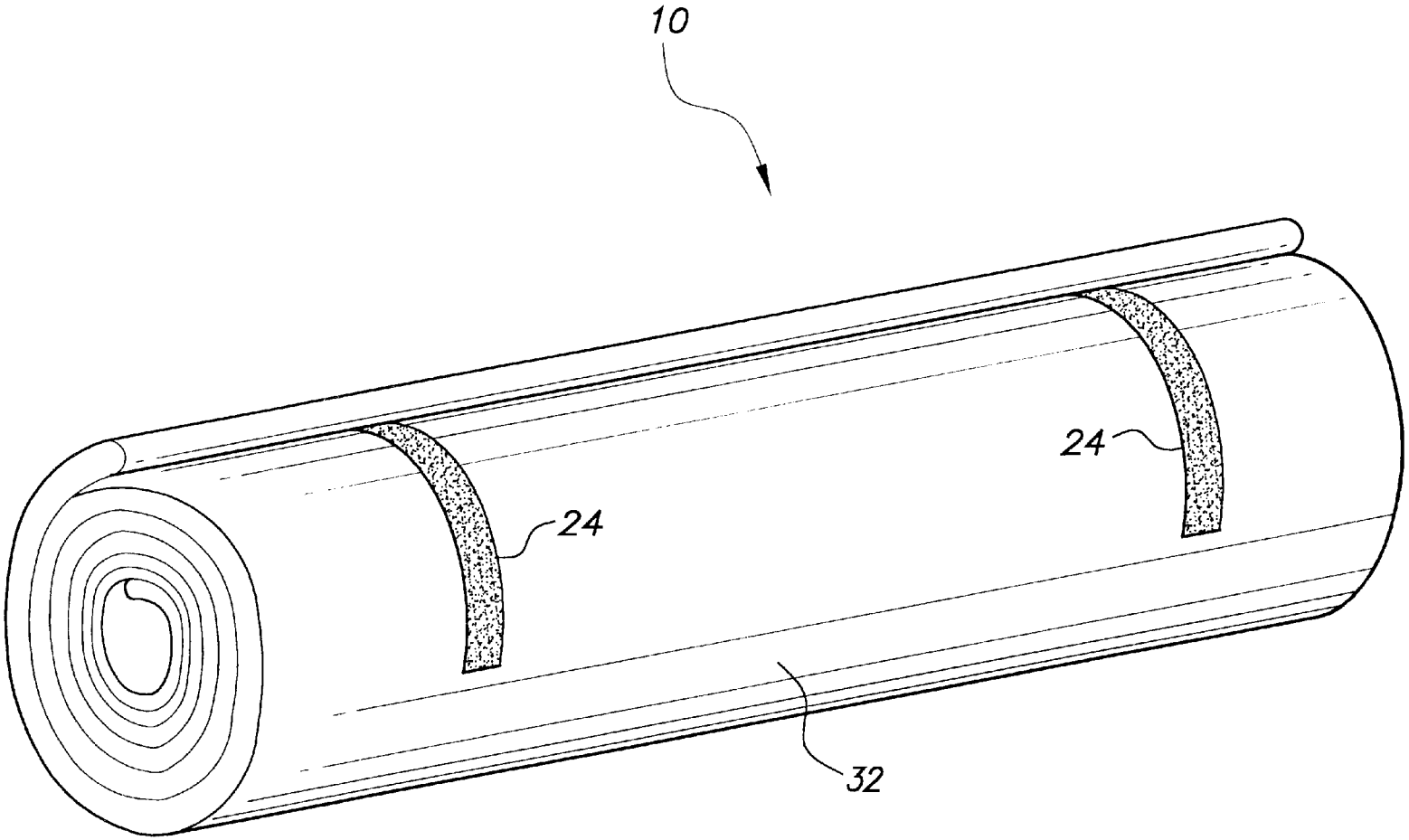
FIG. 5 is a perspective view of a soft drum case rolled for storage.

When the soft case 10 is not surrounding a drum it can be rolled and conveniently stored as seen in FIG. 5. Rolling the case 10 is accomplished by rolling the left side toward the right side such that the hook and loop strips 24 may be fastened to hook and loop strip 40 to secure the roll.

It is to be understood that the present invention is not limited to the sole embodiment described above, but encompasses any and all embodiments within the scope of the following claims.

I claim:

1. A soft case for a drum, the drum having a shell, a striking area, and a rim, the case comprising:

a flat, elongated, rectangular cover made from a flexible material and having a front, back, top, bottom, overlapping end and an overlapped end;

a first length of hook and loop fastening material disposed on the front of said cover adjacent to the overlapped end, a second length of hook and loop fastening material disposed on the back of said cover adjacent to the overlapping end, said second length of hook and loop fastening material mating with said first length to define an endless loop when said cover is wrapped around the shell of a drum;

a first drawstring disposed along the top of said cover;

a second drawstring disposed along the bottom of said cover;

an elongated bottom sheath with two opposing ends, the sheath being defined along the bottom of said cover and extending from the overlapping end of said cover up to said first length of hook and loop fastening material;

an elongated top sheath with two opposing ends, the sheath being defined along the top of said cover and extending from the overlapping end of said cover up to said first length of hook and loop fastening material;

each said drawstring having:

first and second end cords, said end cord having an anchor end disposed inside and fixed to the sheath at the opposing ends of the sheath, respectively, and a free end extending through the sheath between the opposing ends of the sheath;

a central cord extending through the sheath and having opposing free ends extending through the sheath adjacent the free ends of said first and second end cords, respectively, said central cord being fixed to the sheath at a midpoint of the cord; and a pair of double cord locks, the free end of each said end cord and the adjacent free end of said central cord being frictionally secured in one of said pair of double cord locks, respectively, whereby the case may be tightened about a drum by pulling the free ends of said end cords and said central cord through each of said double cord locks;

whereby said cover is adapted to encase the drum with the back of said cover facing the shell of the drum and the top and the bottom of said cover extending past the rims of the drum forming two extended portions which cover the rims when said first and said second drawstrings are drawn taut.

2. The soft case as in claim 1, further comprising a strap attached to the front of said cover adapted for use as a handle.

3. The soft case as in claim 1, further comprising a transparent pocket disposed on the front of said cover sized and dimensioned for receiving an identification card.

4. The soft case as in claim 1, further comprising:

a third length of hook and loop fastening material disposed parallel to said top and adapted to adhere to said second length of hook and loop fastening material; and a fourth length of hook and loop fastening material disposed parallel to said bottom and spaced apart from said third length of hook and loop fastening material, the fourth length being adapted to adhere to said second length of hook and loop fastening material.

5. The soft case as in claim 1, further comprising two rings disposed on the front of said cover, each ring being adapted for connection to one end of a shoulder strap.

6. The soft case as in claim 1, further comprising a hand grip attached to each free end of said end cords and said central cord, respectively.

7. The soft case according to claim 1, wherein said cover comprises:

(a) a front layer made from a durable heavy weight fabric;

(b) a back layer made from a durable lightweight fabric; and (c) a middle layer disposed between said front layer and said back layer, the middle layer being made from foam padding.

8. A soft case for a drum, the drum having a shell, a striking area, and a rim, the case comprising:

a flat, elongated, rectangular cover made from a flexible material and having a front, back, top, bottom, overlapping end and an overlapped end;

a first length of hook and loop fastening material disposed on the front of said cover adjacent to the overlapped end, a second length of hook and loop fastening material disposed on the back of said cover adjacent to the overlapping end, said second length of hook and loop fastening material mating with said first length to define an endless loop when said cover is wrapped around the shell of a drum;

a first drawstring disposed along the top of said cover;

a second drawstring disposed along the bottom of said cover;

said first and said second drawstrings are each composed of three elastic cords;

whereby said cover is adapted to encase the drum with the back of said cover facing the shell of the drum and the top and the bottom of said cover extending past the rims of the drum forming two extended portions which cover the rims when said first and said second drawstrings are drawn taut.

* * * * *